US006703998B1

(12) United States Patent
Kabel et al.

(10) Patent No.: US 6,703,998 B1
(45) **Date of Patent: *Mar. 9, 2004**

(54) COMPUTER PROGRAM, METHOD, AND DEVICE FOR CONTROLLING THE BRIGHTNESS OF A DISPLAY

(75) Inventors: Darrin Kabel, Overland Park, KS (US); Scott Brunk, Overland Park, KS (US); Michael Carlson, Olathe, KS (US)

(73) Assignee: Garmin Ltd (KY)

( * ) Notice: Subject to any disclaimer, the term of this patent is extended or adjusted under 35 U.S.C. 154(b) by 0 days.

This patent is subject to a terminal disclaimer.

(21) Appl. No.: 10/434,243

(22) Filed: May 8, 2003

Related U.S. Application Data

(63) Continuation of application No. 09/866,000, filed on May 26, 2001, now Pat. No. 6,590,561.

(51) Int. Cl.[7] ..... G09G 3/36
(52) U.S. Cl. ..... 345/102; 345/89; 349/61
(58) Field of Search ..... 345/102, 87, 89, 345/207, 690; 349/61, 64, 65

(56) References Cited

U.S. PATENT DOCUMENTS

| | | | | |
|---|---|---|---|---|
| 4,958,915 A | | 9/1990 | Okada et al. | 350/345 |
| 5,019,808 A | | 5/1991 | Prince et al. | 340/765 |
| 5,406,305 A | | 4/1995 | Shimomura et al. | 345/102 |
| 5,428,265 A | | 6/1995 | Booth, Jr. et al. | 315/158 |
| 5,719,474 A | | 2/1998 | Vitello | 315/307 |
| 5,724,062 A | | 3/1998 | Hunter | 345/102 |
| 5,783,909 A | | 7/1998 | Hochstein | 315/159 |
| 5,933,089 A | | 8/1999 | Katada | 340/825.44 |
| 6,081,073 A | | 6/2000 | Salam | 315/169.2 |
| 6,291,942 B1 | | 9/2001 | Odagiri et al. | 315/169.3 |
| 6,366,350 B1 | | 4/2002 | Thornburg et al. | 356/222 |
| 6,452,582 B1 | | 9/2002 | Rolston | 345/102 |
| 6,590,561 B1 | * | 7/2003 | Kabel et al. | 345/102 |
| 2001/0035848 A1 | | 11/2001 | Johnson et al. | 345/76 |
| 2002/0130786 A1 | | 9/2002 | Weindorf | 340/815.45 |
| 2002/0135572 A1 | | 9/2002 | Weindorf | 345/204 |
| 2002/0140880 A1 | | 10/2002 | Weindorf et al. | 349/70 |

* cited by examiner

*Primary Examiner*—Regina Liang
(74) *Attorney, Agent, or Firm*—Devon A. Rolf

(57) ABSTRACT

A computer program, method, and device for controlling the brightness of a display (10) by proportionally varying the voltage delivered to each pixel in the display (10) after the back light (12) for the display (10) has been dimmed to its approximate lowest level. The display (10) includes a back light (12); a display module (16) having an array of pixels that may be individually controlled to selectively block or pass light from the back light (12) to create a desired image; a user interface (24) for selectively adjusting brightness of the back light (12) to vary the amount of light passing through the pixels to control the brightness of the image; and a controller (22) for proportionally adjusting the luminosity of the pixels to further control the amount of light passing through the pixels to control the brightness of the image.

8 Claims, 1 Drawing Sheet

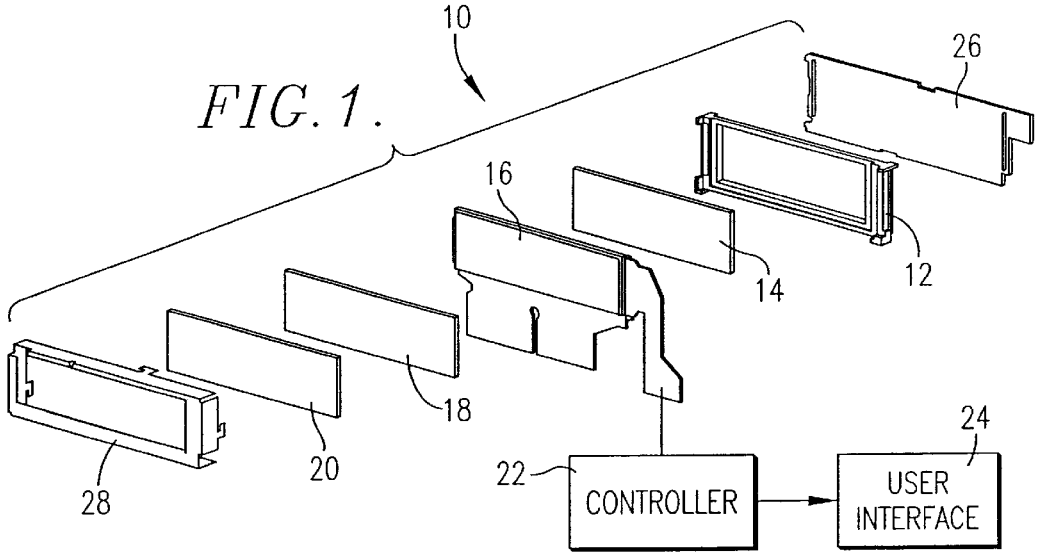
FIG. 1.
FIG. 2.
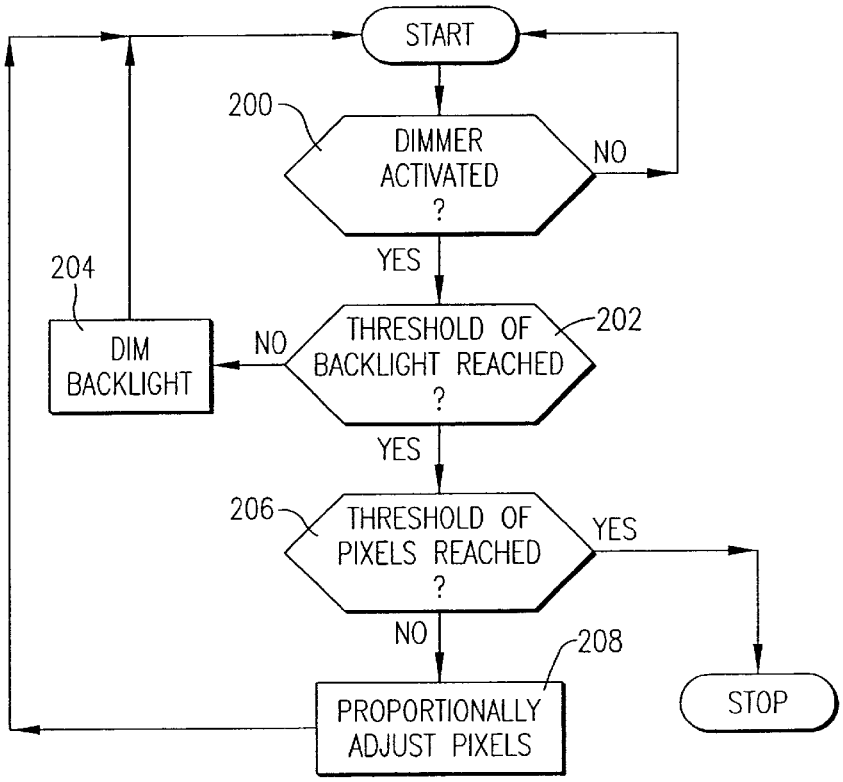

COMPUTER PROGRAM, METHOD, AND DEVICE FOR CONTROLLING THE BRIGHTNESS OF A DISPLAY

This is a continuation of application Ser. No. 09/866,000, filed May 26, 2001, now U.S. Pat. No. 6,590,561.

BACKGROUND OF THE INVENTION

1. Field of the Invention

The present invention relates to displays used in electronic devices such as laptop computers and avionics and marine equipment. More particularly, the invention relates to a computer program and method for controlling the brightness of a display by proportionally modifying the luminosity of each pixel in the display.

2. Description of the Prior Art

Thin-film transistor (TFT) liquid crystal displays (LCDs) and other types of displays are commonly used in a variety of electronic devices, including laptop computers, avionics and marine equipment, and global positioning satellite (GPS) receivers. Such displays typically have back lights that may be adjusted to brighten the displays when used in bright light and dim the displays when used in low light.

Adjusting the brightness of a back light to brighten or dim a display works well in most applications; however, back lights can only be dimmed so much before they effectively turn off entirely. Thus, once the lowest threshold of a back light has been reached, its display cannot be effectively dimmed any further. Those skilled in the art will appreciate that it is often desirable to dim a display beyond the lowest threshold of its back light in some environments such as in the cockpit of an aircraft or boat at night.

Accordingly, there is a need for an improved display and method of operation that overcomes the limitations of the prior art.

SUMMARY OF THE INVENTION

The present invention solves the above-described problems and provides a distinct advance in the art of display technology. More particularly, the present invention provides a computer program, method, and device for controlling the brightness of a display by proportionally varying the charge delivered to each pixel in the display after the back light for the display has been dimmed to its approximate lowest level.

One embodiment of the display of the present invention broadly includes a back light; a display module having an array of pixels that may be individually controlled to selectively block or pass light from the back light to create a desired image; a user interface for selectively adjusting the brightness of the back light to vary the amount of light passing through the pixels to control the brightness of the image; and a controller for proportionally adjusting the luminosity of the pixels to further control the amount of light passing through the pixels to control the brightness of the image. Thus, the controller and the user interface cooperate for dimming the display module in two ways: first by dimming the back light until it reaches its lowest threshold, and then by proportionally reducing the luminosity of the display module pixels to further limit the amount of light that passes through the pixels.

The preferred display also includes a color filter to render light passing through each of the pixels either red, green, or blue. These colors are combined and varied in intensity to create different color combinations. To dim the brightness of the display beyond the threshold of the back light, the controller proportionally lowers the values of the red, green, and blue components of all colors on the display. This dims the display while still maintaining the relative color gradations of the display.

By constructing a display as described herein, numerous advantages are realized. For example, by proportionally adjusting the luminosity of the pixels of the display, the brightness of the display can be further dimmed once the back light has been dimmed to its approximate lowest level. This allows the brightness of the display to be dimmed beyond the lowest threshold of the back light to accommodate for special operating environments such as in an aircraft or boat cockpit at night.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein:

FIG. 1 is an exploded isometric view of the components of a display constructed in accordance with a preferred embodiment of the present invention.

FIG. 2 is a flow diagram depicting certain steps performed in a preferred embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Turning now to FIG. 1, a display 10 constructed in accordance with a preferred embodiment of the invention is illustrated. The display 10 may be used in or with any electronic devices such as laptop computers, avionics and marine equipment, and GPS receivers. A preferred application for the display is in avionics and marine equipment manufactured and sold by Garmin International, Inc. of Olathe, Kans.

The display 10 broadly includes a back light 12, a diffuser panel 14, a display module 16, a color filter 18, an anti-reflective lens 20, a brightness controller 22, and a user interface 24. The back light 12, diffuser panel 14, display module 16, color filter 18, and anti-reflective lens 20 are preferably sandwiched between a conventional mounting board 26 and a frame 28. The controller 22 and user interface 24 may be integrally mounted with the other components of the display 10 or may be mounted in a separate enclosure attached to the other components of the display 10.

The back light 12 is entirely conventional and is provided to direct light through the display module 16 to form images on the face thereof. The back light 12 may incorporate any conventional light source such as light-emitting diodes (LEDs) or high-intensity, cold-cathode flourescent tubes.

The diffuser panel 14 is positioned between the back light 12 and the display module 16 to diffuse and uniformly polarize light emitted from the back light 12. This permits the light to be more effectively acted upon by the display module 16.

The display module 16 is preferably a conventional thin-film transistor (TFT) liquid crystal display (LCD) display module having an array of pixels arranged on a glass substrate. The display module 16 preferably utilizes active matrix technology wherein each pixel is activated by a separate transistor. An image is created on the display module 16 by applying an electric charge to certain pixels to change the pixels' light absorption properties to vary the amount of light from the back light 12 that passes through the pixels.

The display module 16 may be formed with any number of pixels, and each pixel may be separately activated by various levels of voltage. For example, the display module 16 may include 128 rows and 240 columns of pixels with 256 levels of brightness per pixel. The display module 16 may employ several variations of liquid crystal technology, including super twisted nematics (STN), dual scan twisted nematics (DSTN), ferroelectric liquid crystal (FLC), and surface stabilized ferroelectric liquid crystal (SSFLC). Other display technologies, including metal-insulator-metal (MIM), may also be used.

The display 10 preferably displays color images and therefore includes a color filter 18. The color filter 18 is positioned in front of or is formed on the front face of the display module 16 and is provided to color light passing through the pixels either red, green, or blue. The color filter 18 includes a glass substrate with individual pixel filter areas integrated thereon that block all wavelengths of light except those within the desired color range of a pixel. The areas in between the colored pixel filter areas are preferably printed black to increase contrast between the various colors. When the display 10 is used for avionics purposes, the choices of colors for symbols and graphics is guided by TSO C113 standards for EFIS displays. Color use on the display 10 may be varied or fixed. For example, if color use is fixed, land areas may always be displayed as black, water as blue, air space boundaries as green, labeling and some course lines as white, and the active course line as magenta.

The anti-reflective lens 20 is positioned in front of the display module 16 and the color filter 18 and is provided to polarize light passing through the color filter 18 to sharpen images and eliminate glare. The anti-reflective lens 20 is preferably a separate component, but it may also be integrally formed with the color filter 18 and/or the front face of the display module 16.

The brightness controller 22 and user interface 24 are electrically coupled with the display module 16 and together control the brightness of the display module 16. The controller 22 may be any conventional computing device such as a microprocessor or micro controller. The controller 22 may be part of a gate driver or data driver that drives the pixels of the display module 16 or may be a separate dedicated component. The user interface 24 may be any type of device that provides input to the controller 22 such as a touch-screen menu display having up/down arrows or a manually-activatable slider bar.

The controller 22 and user interface 24 may be operated to either brighten or dim images created on the display module 16. Images may be brightened in a conventional manner. Specifically, an operator may press an up arrow or operate a slider bar on the user interface 24 to increase the intensity of the back light 12.

The controller 22 and user interface 24 cooperate for dimming the display module 16 in two ways: first by dimming the back light 12, then by proportionally reducing the luminosity of the pixels of the display module 16. More specifically, the display module 16 is first dimmed by decreasing the brightness of the back light 12 in a conventional manner. Once the back light 12 has been dimmed to its lowest level before it turns off or to a selected threshold level, the display 10 may then be further dimmed by controlling the luminosity of each pixel of the display 10 to limit the amount of light that passes through the display module 16. This may be accomplished via a variety of different means, depending on the display technology used. In the case of an active matrix display, the luminosity of the pixels may be reduced by proportionately reducing the voltage to each and every active pixel used to create an image. For example, if an image requires five pixels on the display module 16 to have brightness levels of 50, 100, 150, 200, and 250 (on a scale of 0–255), and it is desired to dim the display 10, the voltage delivered to each of these pixels may be proportionally reduced to brightness levels of 25, 50, 75, 100, and 125 so that each active pixel is proportionally dimmed by 50%. When the display 10 includes a color filter 18 so as to display color images, the red, green, and blue subcomponents of each color presented by the display 10 are reduced in a proportional manner so as to dim the display 10 while maintaining relative color variations on the display 10.

The flow chart of FIG. 2 shows in more detail the functionality and operation of a preferred implementation of the controller 22 and user interface 24 to dim the display module 16. Some of the blocks of the flow chart may represent a module segment or portion of code of the computer programs of the present invention which comprises one or more executable instructions for implementing the specified logical function or functions. In some alternative implementations, the functions noted in the various blocks may occur out of the order depicted in FIG. 2. For example, two blocks shown in succession in FIG. 2 may in fact be executed substantially concurrently, or the blocks may sometimes be executed in the reverse order depending upon the functionality involved.

The dimming routine begins when the controller 22 senses a request to dim the display module 16 as depicted in step 200 of FIG. 2. For example, an operator wishing to dim an image may press a down arrow or operate a slide bar on the user interface 24. The controller 22 then determines if the lowest threshold of the back light 12 or a pre-selected threshold level has been reached as depicted in step 202. The lowest threshold of the back light 12 is preselected and may be any percentage of the full brightness of the back light 12. For example, through experimentation, it may be determined that the back light 12 ceases to emit appreciable light at a power level of 25%. This 25% level may then be preset as the lowest threshold for the back light 12. If the lowest threshold of the back light 12 has not been reached, the program proceeds to step 204 where the controller 22 dims the back light 12 the amount requested by the user interface 24 to reduce the amount of light passing through the display module 16. The routine then starts over to await further requests to dim the display module 16.

If the controller 22 determines that the lowest or preselected threshold of the back light 12 has been reached in step 202, the routine proceeds to step 206 where the controller 22 determines whether the lowest threshold of the pixels has been reached. The lowest threshold for the pixels may be preselected and may be any percentage of the normal voltage levels for the pixels. For example, it may be determined that the pixels fail to operate properly if their voltage level is reduced by more than 75%. If so, 25% of the pixels' normal operating voltage may be preset as the lowest threshold for the pixels. If the lowest threshold for the pixels has been reached, the routine ceases dimming the display module 16.

If, however, the lowest threshold for the pixels has not been reached in step 206, the routine proceeds to step 208 where the controller 22 proportionally adjusts the voltage level of all active pixels. The user interface 24 and the controller 22 may be configured to reduce the voltage levels delivered to the pixels in discrete steps or may provide an analog, infinite amount of reduction levels.

The steps described above can be implemented in hardware, software, firmware, or a combination thereof. In a preferred embodiment, however, the steps are preferably implemented with a computer program stored on or accessible by the controller.

The computer program preferably comprises an ordered listing of executable instructions for implementing logical functions in the controller 12. The computer program can be embodied in any computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electromagnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM). The computer-readable medium could even be paper or another suitable medium upon which the program is printed, as the program can be electronically captured, via for instance, optical scanning of the paper or other medium, then compiled, interpreted, or otherwise processed in a suitable manner, if necessary, and then stored in a computer memory.

From the foregoing, it can be seen that the display 10 of the present invention provides advantages over prior art displays that merely provide dimming through adjustment of a back light. By proportionally adjusting the luminosity of the pixels of the display module 16, the brightness of the display 10 can be further dimmed once the back light 12 has been dimmed to its approximate lowest level. This allows the brightness of the display 10 to be dimmed beyond the lowest threshold of the back light 12 to accommodate for special operating environments. Moreover, because the controller 22 proportionally reduces the voltage level to all active pixels, and therefore the red, green, and blue color components of a color when the display 10 is used to display color images, relative gray scale and color variations on the display 10 are maintained.

Although the invention has been described with reference to the preferred embodiment illustrated in the attached drawing figures, it is noted that equivalents may be employed and substitutions made herein without departing from the scope of the invention as recited in the claims. For example, although the preferred display includes a color filter 18 for displaying color images, the dimming routine of the present invention may be used with a monochrome display by proportionally varying the shades of gray of the display 10.

Having thus described the preferred embodiment of the invention, what is claimed as new and desired to be protected by Letters Patent includes the following:

What is claimed is:

1. A display comprising:

a back light;

a display module having an array of pixels that may be individually controlled to selectively block or pass light from the back light to create a desired image; and a controller for proportionally adjusting the luminosity of the pixels of the display module to control the amount of light passing through the pixels to control the brightness of the image, wherein the controller is operable to adjust the luminosity of the pixels after the brightness of the back light has been adjusted to its approximate lowest level.

2. The display as set forth in claim 1, further including a user interface, connected to said controller, for selectively adjusting brightness of the back light to vary the amount of light passing through the pixels of the display module to control the brightness of the image.

3. The display as set forth in claim 1, further including a color filter to render light passing through each of the pixels either red, green, or blue.

4. The display as set forth in claim 3, the controller being operable to proportionally adjust voltage delivered to each of the pixels to proportionally scale the red, green, and blue color light emitted through the color filter.

5. The display as set forth in claim 1, wherein the controller is coupled with the user interface and is operable to adjust the luminosity of the pixels after the brightness of the back light has been adjusted to a selected threshold level.

6. The display as set forth in claim 1, further including a diffuser panel for uniformly polarizing light emitted from the back light.

7. The display as set forth in claim 1, wherein the display module is a liquid crystal display module.

8. The display as set forth in claim 7, wherein the liquid crystal display module is a thin-film transistor device.

* * * * *